United States Patent [19]

McFadyen et al.

[11] 4,398,130

[45] Aug. 9, 1983

[54] ARC LAMP LIGHTING UNIT WITH LOW AND HIGH LIGHT LEVELS

[75] Inventors: Robert J. McFadyen; William Peil, both of Syracuse, N.Y.; John M. Davenport, Lyndhurst; Robert J. Crosby, Wickliffe, both of Ohio

[73] Assignee: General Electric Company, Syracuse, N.Y.

[21] Appl. No.: 355,658

[22] Filed: Mar. 8, 1982

Related U.S. Application Data

[63] Continuation of Ser. No. 107,698, Dec. 27, 1979, abandoned.

[51] Int. Cl.[3] ..... H05B 37/02

[52] U.S. Cl. ..... 315/226; 315/49; 315/72; 315/161; 315/210

[58] Field of Search ..... 315/226, 161, 210, 49, 315/72, 362

[56] References Cited

U.S. PATENT DOCUMENTS

| | | | |
|---|---|---|---|
| 3,059,137 | 10/1962 | Reaves | 315/46 |
| 3,093,769 | 6/1963 | Kuhl et al. | 315/49 |
| 3,138,737 | 6/1964 | French | 315/72 |
| 3,836,814 | 9/1974 | Rodriquez | 315/49 |
| 3,968,936 | 7/1976 | Clune et al. | 315/49 |
| 4,161,672 | 7/1979 | Cap et al. | 313/220 |
| 4,199,170 | 4/1980 | Knoll | 315/DIG. 7 |
| 4,281,274 | 7/1981 | Bechard et al. | 315/49 |
| 4,340,843 | 7/1982 | Anderson | 315/49 |
| 4,348,612 | 9/1982 | Morton | 315/72 |
| 4,350,930 | 9/1982 | Peil et al. | 315/49 |

FOREIGN PATENT DOCUMENTS

| | | |
|---|---|---|
| 1099753 | 1/1968 | United Kingdom . |
| 1199899 | 7/1980 | United Kingdom . |

*Primary Examiner*—Harold A. Dixon

*Attorney, Agent, or Firm*—Richard V. Lang; Carl W. Baker

[57] ABSTRACT

The present invention relates to a lighting unit having low and high light levels and employing an efficient arc lamp as the source of light during the high level setting. The unit employs a filamentary light source for the production of light during low light level operation, the filament acting as a resistive ballast for the arc lamp during high level operation. Practical embodiments operate in a conventional three-way light socket with the sequences being off, low, high and low, and off, low, high, and high.

6 Claims, 6 Drawing Figures

| SWITCH POSITION | BLACK LINE CONNECTION * | SWITCH CONDITION | LAMP CONDITION |
|---|---|---|---|
| 1 OFF | OFF | BLACK OPEN RED ↔ BLUE | BOTH OFF |
| 2 LOW | RING | RED ↔ BLACK BLUE OPEN | FILAMENT ONLY LIGHTED |
| 3 HIGH | EYELET | BLACK ↔ BLUE RED OPEN | ARC LAMP ALONE LIGHTED EXCEPT DURING STARTING |
| 4 LOW | RING AND EYELET | BLACK ↔ BLUE ↔ RED | FILAMENT ONLY LIGHTED |

* WHITE LINE TO SCREW BASE

| SWITCH POSITION | BLACK LINE CONNECTION * | SWITCH CONDITION | LAMP CONDITION |
|---|---|---|---|
| 1 OFF | OFF | BLACK OPEN RED ↔ BLUE | BOTH OFF |
| 2 LOW | RING | RED ↔ BLACK BLUE OPEN | FILAMENT ONLY LIGHTED |
| 3 HIGH | EYELET | BLACK ↔ BLUE RED OPEN | ARC LAMP ALONE LIGHTED EXCEPT DURING STARTING |
| 4 HIGH | RING AND EYELET | BLACK ↔ BLUE ↔ RED | ARC LAMP ALONE LIGHTED EXCEPT DURING STARTING |

* WHITE LINE TO SCREW BASE

ARC LAMP LIGHTING UNIT WITH LOW AND HIGH LIGHT LEVELS

This application is a continuation of application Ser. No. 107,698, filed Dec. 27, 1979, now abandoned.

RELATED PATENTS

U.S. Pat. No. 4,161,672 of Cap and Lake entitled "High Pressure Metal Vapor Discharge Lamps of Improved Efficiency".

U.S. Pat. No. 4,307,334 of Peil and McFadyen entitled "A Transformer for Use in a Static Inverter".

U.S. Pat. No. 4,350,930 of Peil and McFadyen entitled "Lighting Unit".

U.S. Pat. No. 4,258,338 of Peil entitled "A Pulse Generator Producing Short Duration High Current Pulses for Application to a Low Impedance Load".

U.S. Pat. No. 4,282,462 of Peil and McFadyen entitled "An Arc Lamp Lighting Unit With Means to Prevent Prolonged Application of Starting Potentials".

BACKGROUND OF THE INVENTION

1. Field of the Invention

The present invention deals with a lighting unit with low and high light levels, energized from a conventional ac source, and in which the principal source of light is an arc lamp supplemented by a standby filamentary lamp providing light during starting of the arc lamp and during low light levels.

2. Description of the Prior Art

The present invention deals with a lighting unit in which the principal source of light is a high pressure discharge lamp having up to six times the efficiency of an incandescent lamp. High pressure metal vapor lamps have been available for some time in high power units. Recently, as disclosed in U.S. Pat. No. 4,161,672, smaller low wattage metal halide lamps with efficiencies approaching those of the larger size have been invented. Such lamps are an energy efficient replacement for the incandescent lamp.

The power supply of the present lighting unit employs a high frequency power supply in which a ferrite transformer controlled for non-saturated operation, a transistor switch, and a trigger oscillator are the principal components. The inverter and ferrite transformer herein described are the subject of U.S. Pat. Nos. 4,350,930 and 4,307,334.

In the prior application Ser. No. 47,972 the high and low settings of the lighting unit are achieved by inserting one or two resistances in series with the arc lamp. The present invention is directed to an alternative solution to the dimming problem in which the low light level is provided by an incandescent element and the high light level by the arc lamp. It is of course desirable that the lighting unit be usable in a conventional as well as a three-way socket.

SUMMARY OF THE INVENTION

It is an object of the present invention to provide an improved lighting unit employing an arc lamp and having a low and a high light level setting.

It is a further object of the invention to provide an improved lighting unit in which an arc lamp provides high illumination and an incandescent lamp provides low illumination.

It is still another object of the present invention to provide an improved lighting unit using an arc lamp suitable for use in a three-way socket and having successively low, high and low brightness settings, or alternatively low, high and high brightness levels.

These and other objects of the invention are achieved in a lighting unit having three terminals for selective connection to an ac supply, and including a rectifier bridge having a pair of ac input terminals and a pair of dc output terminals with a first, filter capacitor being connected across the dc output terminals.

The lighting unit further includes a main arc lamp connected in a series path between a node and the common bridge output terminal or ground, and a resistive filament connected in a series path between the positive bridge output terminal and the node. In the low setting, the filament provides low level illumination. In the high setting, the filament provides standby illumination during starting of the main lamp and ballasting action for the arc lamp.

The lighting unit further includes an electrical transformer having a primary winding connected in a series path between the positive bridge output terminal and the node and a second winding connected in a series path between the node and the lamp anode; a first diode connected in the series path between the first node and the lamp anode in a polarity to conduct main lamp current through the filament and in shunt with the second winding for rectifying transformed potentials; a monostable, normally nonconductive, solid state switch comprising a first transistor connected in a series path between the first node and ground, intermittent operation of the switch developing a pulsating current in the filament for stand-by illumination, an alternating potential in the primary winding, and a transformed alternating potential in the second winding, rectified by the first diode and coupled to the anode of the main lamp for starting; a rectifier device such as an SCR or a transistor or a diode connecting the first node to the lighting unit third terminal in a polarity to allow half-wave conduction through the rectifier bridge and the filament for filamentary illumination in the low setting, and means to maintain the solid state switch in a nonconductive state in the low setting.

In a preferred form, a trigger oscillator is provided responsive to the electrical state of the main lamp for causing intermittent switch operation for starting the main lamp, comprising a second transistor in an oscillatory configuration, a resistive voltage divider serially connected between the node and ground, and a lamp current sensing resistance connected between the lamp cathode and ground. The base of the second transistor is connected to a lower tap on the voltage divider for sensing the voltage across the arc lamp and the emitter of the second transistor is connected to the arc lamp current sensing resistance.

When the rectifier device is a diode, the preferred means for maintaining the solid state switch in a nonconductive state during low light level settings functions by maintaining the trigger oscillator in a non-oscillatory condition. Included are several diodes, resistors, and a second capacitor. A second diode has its cathode coupled to the third lighting unit terminal and its anode connected to the positive terminal of a second capacitor, the negative terminal being grounded. A third diode has its cathode connected to the anode of the second diode, and its cathode coupled to an upper tap on the voltage divider. These components prevent the trigger oscillator from operating during the low setting.

A second resistance is provided coupled between the first node and the second capacitor for charging the second capacitor to a value which reversely biases the second diode and decouples the second capacitor from the voltage divider during the high light level setting. This permits immediate response to line transients during normal lamp operation, undelayed by the second capacitor.

A third resistance is provided shunting the second capacitor, selected to sustain a reverse bias on the third diode during normal operation and to reduce the voltage stresses on the second capacitor in the high setting.

A serially connected pair of diodes is provided between the dc output terminals of the bridge, with the diode interconnection being connected to the lighting unit third terminal. This provides protection from transients on the line, when only the first and third lighting unit terminals are connected to the ac supply, and also protection from starting current surges when the lighting unit is first turned on.

The lighting unit so far described may be connected to a three-way socket with the first terminal of the lighting unit going to the screw base, the second lighting unit terminal going to the eyelet of the socket, and the third lighting unit terminal going to the ring contact in the socket. When so connected, the lighting unit will provide successively low, high and low light level settings.

When the aforesaid rectifier device is an SCR, the preferred means for maintaining the solid state switch in a non-conductive state during the low light level setting functions by preventing sufficient voltage to develop on the filter capacitor to operate the trigger oscillator. With this use of an SCR, the lighting unit will provide successively low, high, and high light level settings.

BRIEF DESCRIPTION OF THE DRAWINGS

The novel and distinctive features of the invention are set forth in the claims appended to the present application. The invention itself, however, together with further objects and advantages thereof may best be understood by reference to the following description and accompanying drawings in which:

DESCRIPTION OF PREFERRED EMBODIMENT

Figure 1:
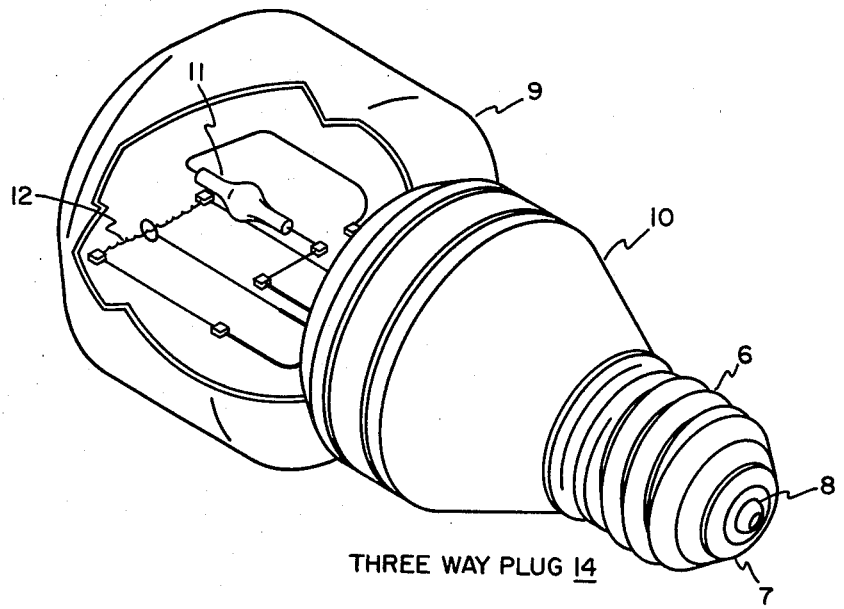
FIG. 1 is an illustration of a novel lighting unit having a low and a high illumination setting, suitable for connection to a standard or a three-way lamp socket and using an arc lamp light source during the high setting and a filamentary light source during the low setting.

Referring now to FIG. 1, a novel lighting unit for operation from a conventional low frequency (50–60 Hz) alternating current power source is shown. The lighting unit comprises a lamp assembly which produces light and a power supply unit which supplies electrical power to the lamp assembly. The lighting unit has two levels of illumination, high and low, provided by a "three-way" switch in the lamp socket. The lamp assembly includes a glass enclosure 9 which contains a high efficiency arc lamp 11 and a resistive filament 12 for both ballasting and light production. The power supply unit includes a rigid case 10 attached to the glass enclosure and a screw-in "three-way" plug 14. The plug 14 is a conventional "three-way" plug normally used with a light having three levels of illumination. The plug has three points for connection including a screw base 6, a ring 7 and an eyelet 8. The plug provides both electrical connection and mechanical attachment of the lighting unit to a conventional three-way lamp socket.

The power supply unit supplies the energization for both filament and arc lamp. During the high setting, the power supply unit develops the required energization for the main arc lamp during starting and operating conditions and provides immunity to certain line transients. Also during the high setting, the power supply unit provides power for supplemental filamentary light production but only when needed during starting. During the low setting, the power unit supplies power for light production by the filament on a continuous basis and supplies no power to the main arc lamp.

The filament and arc lamps are individually associated with the low and high light levels respectively except during starting in the high setting when both are involved in light production. The low light level is provided by the filamentary light source, and the high light level is provided by the arc lamp. In the low setting, the arc lamp is off and light is produced by the filament alone. In the high light level setting, the lighting unit may be switched on, restarted, or turned off with the same immediate production of light as an incandescent element. During the periods that it may take for the arc lamp to reach full brightness after a cold start or the longer periods required for a hot restart, supplemental incandescent illumination is provided by the filamentary light source.

The disposition of the elements of the lamp assembly are best seen in FIG. 1. The arc lamp 11, and the 60 watt filament 12 are all installed inside the single large glass envelope 9. The elements 11 and 12 are supported on leads sealed into the base of the lamp assembly. The gas filling the envelope 9 is an inert gas suitable for a conventional incandescent lamp. The arc lamp 11 is shown with the positive electrode or anode down (near to the base) and the negative electrode or cathode up (remote from the base). The two electrodes are in turn sealed into the ends of a small quartz vessel whose outer contour is cylindrical except for a small central region of larger cross section, of less than ½" in diameter. The interior of the arc lamp, which is not specifically illustrated, contains a spherical or elliptical central chamber filled with an ionizable mixture: argon, an ionizable starting gas, mercury, which is vaporized when hot, and a vaporizable metal salt such as sodium and scandium iodides. When operating, an arc is formed between the electrodes which creates illumination throughout the chamber. Small, low power lamps of the type just described are referred to as metal halide or metal vapor lamps. A suitable lamp is more fully described in the earlier cited U.S. Pat. No. 4,161,672.

During normal final run operation the power supplied to the arc lamp is dc having some low frequency (50–60 Hz) ripple. In starting or restarting, the power supplied to the arc lamp and the filament has substantial high frequency content and means are provided for preventing prolonged starting, such as might occur when arc lamp failure precludes ignition.

The arc lamp exhibits several distinct states in conventional use and each active state requires distinct energization. From a practical viewpoint, the arc lamp has three essentially active states denominated Phases I–III and an inactive state.

In Phase I, "ignition" occurs. The duration of ignition should be no longer than a second or two and is often much shorter. It is the time required for a suitably high voltage to cause "electrical breakdown" of the gas contained in the arc lamp to initiate a falling maximum lamp voltage. This latter condition is also referred to as the establishment of a "glow discharge".

Phase II—the glow to arc transition—extends from one-tenth of a second to perhaps two seconds and is characterized by a more sustained ionization level and a lower maximum voltage. As Phase II begins, the discharge is typically unstable, swinging between a maximum and a minimum value, with the voltage of the discharge falling continuously toward a lower maximum with a recurring minimum near 15 volts. As the average level of gas conduction increases, the maximum lamp voltage falls, the consumed power increases, and the temperatures inside the lamp also increase. As the maximum arc voltage falls through values near 200–400 volts, a more substantial energy (typically 2–4 watts) is required by a metal vapor lamp.

Phase III begins with the establishment of the "arc" which occurs when a portion of the cathode has reached thermionic emission temperatures. At the marked transition from Phase II to Phase III, the voltage of the discharge loses its unstable quality and holds to an initial value of about 15 volts. In Phase III, a sustained low lamp impedance is exhibited, and current limiting is required to prevent excessive heating. At the beginning of Phase III, the lamp dissipation is set to be between 10 and 15 watts and significant light production starts.

The warm-up period, which is the initial portion of Phase III, normally lasts from 30–45 seconds. During the warm-up period, the lamp reaches full operating temperature and the contained gases reach their high, final operating pressures. The voltage across the lamp increases to a value of typically 87 volts with an accompanying reduction in lamp conductance. When the final run condition occurs, the lamp absorbs the maximum power (typically 32 watts) and the maximum light output is produced.

The pre-ignition period is a variable period having a nominal minimum value of zero at standard ambient conditions and a maximum value between 45 seconds and 4 minutes if there has been a failure of the arc and a hot restart is required. If the lamp is de-energized in the course of normal operation, the lamp will be at an elevated temperature and at a high gas pressure for a short while. To restrike the arc when the lamp is hot, the potential required may be in excess of an order of magnitude more than for a cold start (e.g., 10–30 KV). The thermal time constants of the lamp are such that the time required for cooling from a hot operating condition to the point where a conventional (1–2 KV) voltage will restrike an arc may be from 45 seconds to 4 minutes.

Supplemental incandescent illumination is particularly important during the longer warm-up and pre-ignition periods, but in the interests of steady illumination, supplemental incandescent illumination is provided through the shorter periods (ignition and the glow to arc transition) as well.

Figures 2A, 2B:
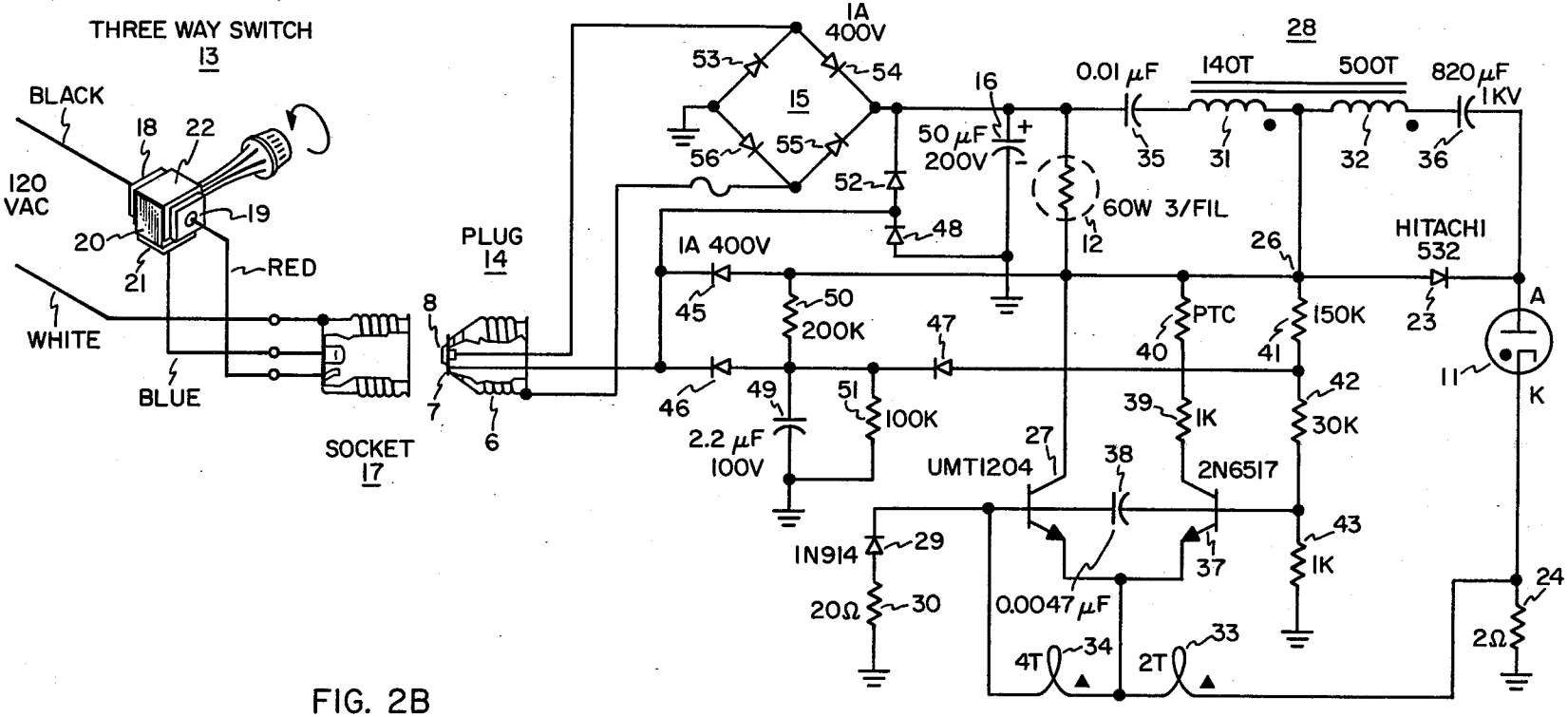
FIG. 2A is an electrical circuit diagram of the lighting unit incorporating a compact power supply unit and including the connections of the lighting unit into a three-way socket.
FIG. 2B is a table of switch and lamp conditions when the novel lighting unit is employed in a three-way socket and exhibits a low, high, low light level sequence.

Suitable operating power for the arc lamp and the standby light producing filament is provided by the power supply illustrated with the lamp socket assembly in FIG. 2A.

The lighting unit whose electrical circuit diagram is illustrated in FIG. 2A, has as its principal components the arc lamp 11, the filamentary lamp 12, a dc power supply (14, 15, 16) for converting the 120 volt 60 Hz ac to dc, and an operating network (23–52) for converting electrical energy supplied by the dc power supply into the forms required for operation of the lamp assembly. The lamp socket assembly, whose wiring is illustrated in FIG. 2A, includes a three-way switch 13 (switch components 18–22), a lamp socket 17 and suitable means for connection to a 120 volt ac supply.

The lamp socket assembly is conventional. The black lead from the ac supply is connected to the stationary contact 18 of the three-way switch to the left of the rotor member 20 (as seen in FIG. 2A). The white lead from the ac supply is connected to the screw base of the socket 17 where it makes contact with the screw base 6 in the lighting unit plug 14. The stationary contact positioned on the right side of the rotor member is connected by a red lead to the socket contact which makes contact with the ring 7 of the lighting unit plug. The stationary contact 21, positioned beneath the rotor motor member is connected to the socket contact, which makes contact with the eyelet 8 of the lighting unit plug. The rotor member 20 is seen to be a generally rectangular member, approximately square in cross-section, to three sides of which a continuous conductor 22 is applied. Dependent on rotation, the rotor member makes selective contact with the stationary contacts 18, 19 and 21. In accordance with the table illustrated in FIG. 2B, the switch provides a four position sequence. In the first position, the uncontacted surface of the rotor member abuts the stationary contact 18 to the black lead of the ac supply and the lighting unit is off. Assuming counter-clockwise rotation to the second position (the illustrated position) the rotor member 22 connects the stationary contacts 18 and 19 together, and the black ac supply lead is connected to the ring 7 of the lighting unit plug. In the third position, the rotor member 22 connects the stationary contacts 18 and 21 together, and the black ac supply lead is connected to the eyelet 8 of the plug. In the fourth position, the rotor member 22 connects all three stationary contacts together, and the black ac supply lead is connected to the ring 7 and the eyelet 8 of the plug. From this it may be seen that the lower input terminal of the diode bridge is at all times coupled to the white ac supply lead, while the upper input terminal of the diode bridge and third input terminal of the lighting unit (ring 7) are separately or jointly connected to the black ac supply lead in accordance with the table illustrated in FIG. 2B.

The dc power supply circuit of the lighting unit is conventional comprising a bridge rectifier 15 and a filter capacitor 16. Energy is supplied from a 120 volt 60 hertz ac source via the plug 14 to the ac input terminals of a full wave rectifier bridge 15 in positions 3 and 4 as described above.

The positive output terminal of the bridge becomes the positive output terminal of the dc supply and the negative output terminal of the bridge becomes the common "ground" or reference output terminal of the dc supply. The filter capacitor 16 is connected across the output terminals of the bridge to reduce ac ripple.

The output of the dc power supply during final run operation of the arc lamp 11 at the high setting is 145 volts at about ½ amperes current, producing an output power of approximately 50 watts of which 32 watts is expended in the lamp. In the high setting, the power required of the dc power supply by the lighting unit during a hot restart is approximately 60 watts and the maximum required during warm-up of the arc lamp is approximately 75 watts. In the low settings, power is supplied to the filament only, using the bridge 15 in a half wave rectification mode. With half wave rectification, the conventional 60 watt filament produces a dissipation of about 38 watts.

The operating network, which derives its power from the dc supply, and in turn supplies energy to the lamp assembly, comprises the elements 23–52 connected together as follows. The filamentary light source 12, diode 23, arc lamp 11 and lamp current sensing resistance 24 are serially connected in the order recited between the positive terminal and the common terminal of the dc supply. The diode 23, which is poled for easy current flow from the dc source to the arc lamp, has its anode coupled to the node 26 and its cathode coupled to one terminal of the arc lamp 11. The arc lamp, which has a required polarization, has its anode coupled to the cathode of the diode 23 and its cathode coupled to one terminal of the current sensing resistance 24.

Continuing with a description of the operating network, a triggered monostable solid state switch is provided, constituted of a power transistor 27, a step-up transformer 28, and components 29, 30. The power transistor has base, emitter and collector electrodes. The step-up transformer has a ferrite core for high frequency operation (>20 Khz), a main primary winding 31, a main second winding 32, a primary control winding 33 and a secondary control winding 34, all associated with the core. The control windings provide a transistor conduction control whose sense is responsive to the magnetic state of the ferrite core and produce monostable action, avoiding full core saturation. The main primary winding 31 has its undotted terminal coupled through the capacitor 35 to the positive dc supply terminal and its dotted terminal connected to the node 26. The main second winding of transformer 28 has its undotted terminal connected to the node 26 and its dotted terminal connected through the capacitor 36 to the anode of the arc lamp 11. The emitter of the power transistor is coupled to the unmarked terminal of the primary control winding 33. The marked terminal of the primary control winding 33 is connected to the cathode of the arc lamp 11. The base of the power transistor is coupled to the cathode of a clamping diode 29, whose anode is coupled through resistance 30 to the common dc terminal. The secondary control winding 34 has its unmarked terminal connected to the emitter. The base of transistor 27 is the point for application of a trigger pulse for initiating each conduction cycle.

The triggering oscillator which recurrently turns on the solid state switch is a second portion of the operating network. The trigger oscillator is turned on and off and also shifted in frequency in response to electrical conditions attributable to the electrical state of the arc lamp. The trigger oscillator is also responsive to the temperature of the switching transistor, thus preventing prolonged triggering in the event of arc lamp failure. The trigger oscillator transistor 37 has its emitter coupled to the emitter of transistor 27, its base coupled through the capacitor 38 to the base of transistor 27, and its collector serially connected through the resistance 39 and positive temperature coefficient resistance 40 to the node 26. A voltage sensing voltage divider (41, 42, 43) is provided consisting of resistances 41, 42 serially connected between node 26 and the base of transistor 37 and resistance 43 connected between the base of transistor 37 and the common source terminal. During warm-up and final run operation, both dc states of the lighting unit (in the high setting), the diode 23 is forward biased, and the divider output voltage, at the base of transistor 37, is a direct measure of the lamp voltage. During the high frequency states of the lighting unit (in the high light level setting), the diode 23 is reversely biased when power is delivered to the lamp, so that the voltage on the voltage divider reflects the loading effect of the arc lamp upon the transformer circuit and is an indirect measure of the lamp voltage. The connection of the emitter of transistor 37 to the non-referenced terminal of the resistor 24 in series with the arc lamp 11, makes the trigger oscillator responsive to lamp current in the form of the voltage proportional to the lamp current developed in resistance 24. The trigger oscillator is connected to respond in the manner noted above to the difference in sensed voltages.

The positive temperature coefficient resistor 40 (thermistor), the subject of co-pending application Ser. No. 85,441, locks out the trigger oscillator if starting is unduly prolonged, thermally latching the transistor 37 in a low gain, moderate current saturation mode. The thermistor 40 is in thermal contact with the power transistor 27 and experiences a resistance increase of several orders of magnitude with the abnormal heat rise arising from unduly prolonged starting. The increase in collector resistance produced by the thermistor reduces the gain of the transistor 37, stopping the generation of trigger pulses and forcing the transistor into saturation. The saturation current level is sufficient for self-heating to maintain the thermistor in its high resistance state and thermally latch out the trigger oscillator.

The dimming circuit, which supplies power to the filament 12 during dimmed operation and which prevents high frequency operation of the operating network during dimmed operation, is the last portion of the operating network. In FIG. 2A it comprises the components 45 through 52 not previously characterized, and connects into the operating network at the node 26, the dc common terminal, the ring contact 7 of the plug 14 and the connection between voltage divider resistances 41 and 42 of the trigger oscillator.

The dimming network is completed by the elements 46 through 52, which, among other functions, prevent high frequency operation of the operating network during both low settings by preventing operation of the trigger oscillator. The remaining elements of the dimming circuit are specifically the diodes 46, 47, 48 and 52, the capacitor 49 and the resistances 50 and 51. The cathode of the diode 46 is connected to the ring contact 7 of the plug 14 and also to the cathode of the diode 45. The anode of the diode 46 is coupled to the cathode of the diode 47 whose anode is connected to the interconnection between voltage divider resistances 41 and 42 of the trigger oscillator. A resistance 50 is provided between the node 26 and the interconnection between diodes 46 and 47. The capacitor 49 is connected between the interconnection between diodes 46 and 47 and the dc common terminal. The resistance 51 shunts the capacitor 49. The diodes 52 and 48 are serially connected across the terminals of the capacitor 16. The cathode of diode 52 is connected to the positive capacitor terminal. The anode of diode 59 is connected to both the ring contact 7 of the plug 14 and the cathode of diode 48. The anode of diode 48 is connected to the negative terminal of capacitor 16.

In both low settings, half-wave power is supplied to the filament 12 along a current path including a branch of the bridge 15 and a diode 45. More particularly, with the switch 13 in the first low setting, a current path is provided serially from the white lead (which is unswitched and connected on one side of the ac supply) to the screw base of the socket 17, the screw base 6 of the plug 14, to the lower input terminal of the bridge 15. The current path continues through the diode in the lower right position of the bridge 15 from the anode to the cathode to the unreferenced or positive dc output terminal of the bridge, and through the filament 12 to the node 26. The diode 45, which has its anode coupled to the node 26 and and its cathode coupled to the ring contact 7 of the plug permits half-wave conduction in the sense just described. The current path continues from the cathode of diode 45 via the plug and socket ring contacts, the red lead, the stationary contact 19, the rotary contact 22, and the stationary contact 18. Finally, the contact 18 leads to the black lead which is connected to the other side of the ac supply completing the current path.

In the second low setting, an additional contact is made through switch 13 from the black lead to the upper input terminal of the bridge while a switched contact of the black lead to the cathode of diode 45 and an unswitched contact from the white ac supply lead to the lower input terminal of the bridge continue as before. As in the first low setting, the filament receives power by half wave conduction through diode 45.

In both low settings, the capacitor 16 is supplied with current on a full wave rectification basis. In the first low setting, diodes 48, 52, 55 and 56 comprise a bridge which charges capacitor 16 to the peak ac input potential. In the high position, diodes 53, 54, 55 and 56 perform the bridge rectification function. In the second low setting, all six diodes are used with diode 52 paralleling 54 and diode 48 paralleling 53, since the eyelet terminal 8 is connected to the ring terminal 7.

The dimming network prevents trigger oscillator operation in the first low setting in the following manner. The waveform appearing at the node 26 is a succession of negative going half waves, shifted upwardly so that the negative tips of this waveform are at approximately ground potential and the cut-off tops of the waveform have a positive voltage of approximately 160 volts. As the ring 7 goes negative and the screw base 6 goes positive, the active bridge diode and diode 45 conduct. Since they are of low impedance in relation to the impedance of the filament, the principal voltage drop occurs across the filament and the voltage at the node connected terminal of the filament approaches zero. At the same time, the negative swing of the ring 7 causes the diodes 46 and 47 to conduct, drawing the upper tap on the base connected voltage divider 41, 42, 43 toward ground. This reduces the charge on the capacitor 49 to near ground potential. At the same time the diode 47, which connects the capacitor to the upper tap of the voltage divider 41, 42, 43, clamps the potential at the upper tap to a near zero potential insuring cut-off of the oscillator transistor. During the second half cycle, when the voltage on the ring becomes positive with respect to that on the screw base, the diode 45 is back-biased and the node 26 reaches its maximum positive value (+160 volts). During this half cycle the diode 46 leading to the capacitor 49 is also back-biased, precluding charging of the capacitor by that path. On the other hand, the presence of the positive potential on the node 26 and the resistive paths presented by resistor 50 and resistor 41 (which acts through diode 47) permit charging, and a resulting gradual increase in the voltage across the capacitor 49. The charging time constant is set sufficiently long to insure continued cut-off of the oscillator transistor 37 throughout the half cycle. With the indicated values, the voltage on the capacitor increases to 16 volts, while the voltage on the upper tap increases to the same value plus a diode drop. The voltage at the lower tap connected to the base electrode is the voltage at the upper tap divided by a ratio of 1 to 30 established by the resistances 43 and 42, respectively. Thus, the voltage remains less than approximately a half volt for the entire cycle and insufficient to forward bias the transistor 37. When the next negative swing occurs, the diodes 46, 47 again become conductive discharging the capacitor 49 to near zero and repeating the cycle just described. In the second low setting, the process is essentially as described above. With the indicated values, cut-off is maintained and the trigger oscillator remains inactive, and as a consequence, the switching transistor 27 remains in the normal nonconductive state.

The suppression of trigger oscillations is accomplished without adverse effect upon operation of the lighting unit in the high setting. In other words, the oscillation suppression circuit has no adverse effect upon starting or restarting or upon the arc maintenance function providing immunity of the arc to power line transients. Non-interference is achieved without the need for costly mechanical or electrical switching devices and requires no more than the simple circuit elements herein described. The prevention of interference is achieved primarily by the diode 47 which is maintained reversely biased and thus decouples the capacitor 49 from the base voltage divider during all significant modes of operation in the high setting. When the power is first turned on in the high setting, the capacitor 49 is at an initially low voltage and will initially prevent the trigger oscillator from coming into operation. The capacitor, however, charges quickly, typically in 50 milliseconds, to a value allowing the trigger oscillator to commence oscillation. In the remainder of the starting process, when trigger pulses are being recurrently generated and the transistor switch 27 is switching recurrently, the node 26 alternates between a high positive potential and a near zero potential. The capacitor 49 will charge through resistance 50, and at times through resistance 41 to an average value dependent on the duty cycle but less than the peak value appearing at the node 26. The diode 47 thus isolates the capacitor 49 from the node during the time the switching transistor is on and a portion of the time that the transistor switch is off and at a voltage not yet exceeding that stored on the capacitor 49. This isolation and the large size of the resistances 50 and 41 in the charging paths reduce the current flow into the capacitor 49 so that there is no significant reduction in power for starting the arc lamp. The circuit also has no significant effect upon the operating frequency of the arc lamp since the repetition frequency is determined primarily by the low (1K) resistance 43 and the capacitor 38. Assuming that the arc lamp has reached a normal final run voltage producing approximately 90 volts at the node 26, the capacitor will charge to a value set by the ratio between resistances 50, 51, i.e. one-third that value or 30 volts, permitting the use of a relatively inexpensive 50 volt electroltyic capacitor.

The arc maintenance feature is unaffected by trigger suppression circuitry. The voltage on capacitor 49 sets the voltage on the cathode of diode 47. At the same time, the anode of the diode 47 is connected to a similar tap on the voltage divider circuit 41, 42. At this tap the devision ratio is on-fifth the voltage at the node 26 and assuming that the node is at 90 volts, the diode is reversely biased at approximately 12 volts throughout the run mode. Thus, should the voltage change on the voltage divider or the current in the arc lamp, the input bias on the trigger oscillator transistor 37 remains unaffected by the presence of the capacitor 49 or the other components used to suppress trigger oscillations. In short, the arc maintenance feature is unimpaired.

The pair of diodes 48 and 52 are provided to protect the lighting unit from both high voltage transients and starting surges primarily in the first low position. Transient protection in the high and second low position results from the presence of the bridge and the capacitor 16. The diodes 52 and 53 shunt the filter capacitor 16 and their interconnection point is led to the ring 7, as earlier described. The protection is primarily for the times that the switch is in the second position, but due to contact problems may also be present in the fourth position if the eyelet contact is poor.

The principle of the protection is to discharge any line surges harmlessly through a low impedance diode into the 50 microfarad capacitor 16. The diode 52 protects against positive going surges on the ring coupling the surge into the capacitor 16 via its positive terminal. The diode 48 protects in a similar way from negative going line transients, by coupling the surge into the capacitor 16 via its negative terminal. Inexpensive diodes have quite large current capacities and with a large capacitor to absorbe the charge, any significant current or voltage transients are prevented from being applied to other elements of the circuit.

Protective against starting surges is provided by the diode 48 which is shown connected between the ring and the common dc supply terminal. If one were to remove the line transient protection feature from the present embodiment for cost reasons, diode 48 should still exist in the position shown in FIG. 2A or at the node 26 to prevent node 26 from going negative during the start-up surge. (The second embodiment to be described with reference to FIG. 4A similarly lacks measures for line transient protection.) An adverse consequence of the node 26 going negative is the application of a reverse voltage on the small 2.2 microfarad capacitor 49 and excessive current flow in the output junction of the transistor 27. The condition causing the node to go negative occurs when the lighting unit is first turned on, normally in the first low setting. The critical period is the first instant after turn-on, as the capacitor 16 begins to charge to a positive value. The surge current is determined by the ac line impedance, the series junction elements and the 2 ohm resistance 24 in series across the ac line. A maximum surge of 50 amperes might be expected but a value of 10 amperes is more typical in view of the other series elements. Assuming a 10 ampere surge, the voltage drop across the 2 ohm resistance would be 20 volts negative with respect to circuit ground (in the absence of diode 48). This voltage minus the collector base forward drop of transistor 27 would appear at node 26. Since diodes 45 and 46 are also conducting, this voltage would also appear across capacitor 49. Thus, the presence of diode 48 (in either position) prevents the node 26 from going negative and in turn the normally positive electrode of the capacitor 49 from going negative. By its presence, the diode 48 eliminates the need for an ac tolerant capacitor and permits a relatively low voltage, electrolytic capacitor as earlier described.

With respect to the transistor 27, the diode 48 (in either position) protects it from the same heavy surge current that occurs when the capacitor 16 is first being charged. Commencing with the reference terminal or ground, the path for current through the transistor may be regarded as continuing through resistance 24, windings 33, 34, base and collector respectively of transistor 27, the node 26, diode 45, in and out of the plug and socket connection to ring 7 and base 6 (where the 120 volt ac generator is inserted), the fuse, the lower right diode in the bridge 15, the positive terminal of capacitor 16, whose other terminal is grounded, to complete the circuit. The diode 38, either connected between ground and the ring 7 (with diode 45 conducting) or between the node 26 and ground, is poled in the same direction as the output junction of transistor 27 and connected in parallel with the portion of the circuit just described which includes the 2 ohm resistance 24, windings 33 and 34, base and collector respectively of transistor 27. Initially, when the node 26 goes negative with the initial surge of current into the capacitor 16, most of the current as between transistor 27 and diode 48 will be drawn by the transistor since its junction area is massive in relation to that of the diode 48 and since at lower currents, the effect of the voltage drop in the 2 ohm resistor 24 is negligible in diverting the surge current into the diode 48. As the current surge increases, the voltage of the drop occasioned by the resistor 24 added to that of the transistor output junction will exceed the junction drop of the smaller diode 48. As this occurs, a major portion of any surge current will be diverted into the diode 48 and diverted away from the output junction of the transistor 27, saving the latter from high current stressing. A relatively low cost diode can withstand surges in the tens of amperes without harmful effect and thus it effectively protects the transistor, which is must less tolerant of such surges.

In going to the second low setting from the high setting it is necessary to turn off the arc tube. This is accomplished by diode 45 (when the ring terminal 7 goes negative) stealing the current from the arc tube for a long enough period to extinguish it and by diode 47 which steals base current from the oscillator transistor 37, thus disabling the transient catch feature which would otherwise try to keep the arc tube ionized.

Figures 4A, 4B:
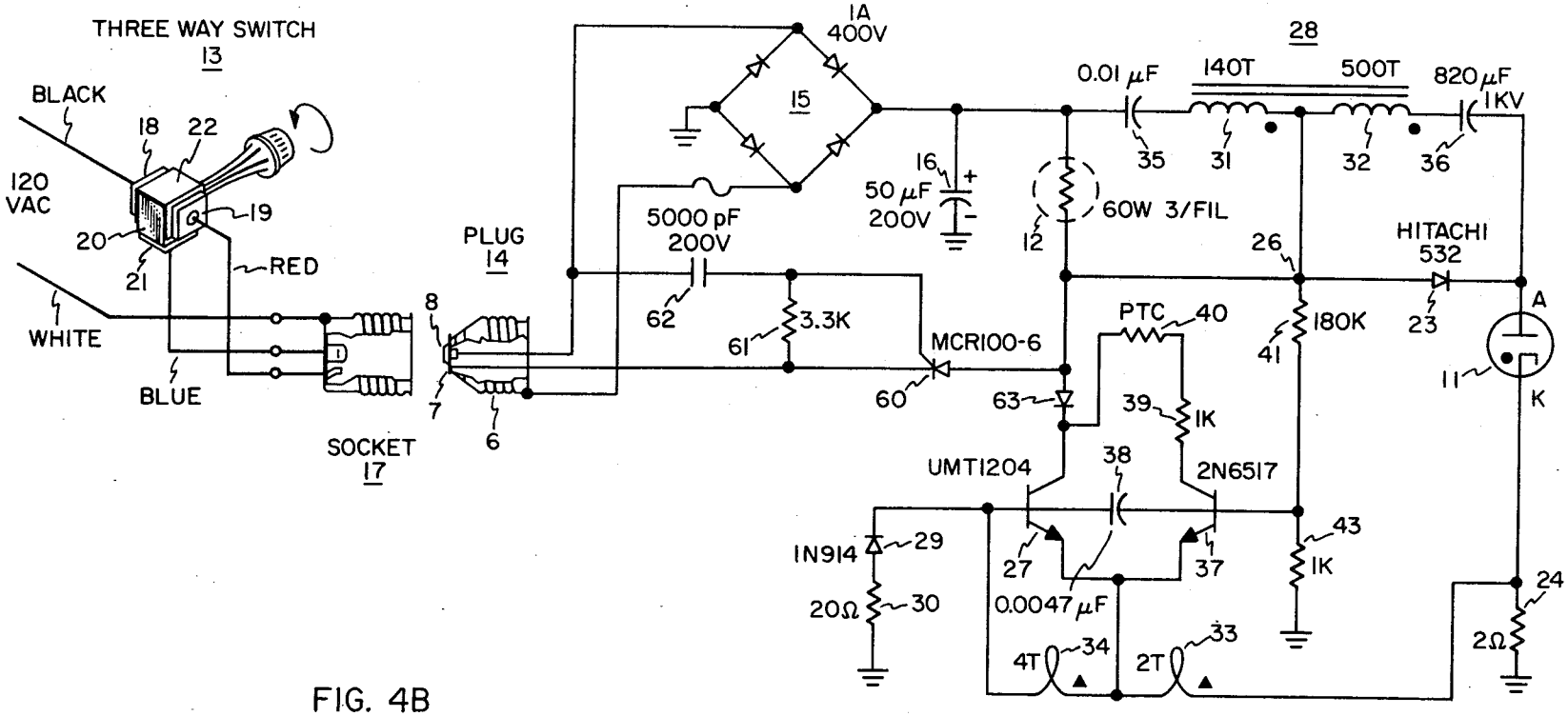
FIG. 4A is an electrical circuit diagram of an alternative embodiment of the invention.
FIG. 4B is a table of switch and lamp conditions for the circuit of FIG. 4A.

FIG. 4A is similar to FIG. 2A except for the dimming circuit. In FIG. 4A the dimming circuit comprises components 60 through 63, which are connected into the circuit at node 26, transistor 27, and the ring contact 7 and eyelet contact 8. The silicon controlled rectifier (SCR) 60 has its anode connected to node 26, cathode connected to the base contact 7, and gate connected to the junction of a resistor 61 and capacitor 62 which are connected in series between the ring 7 and eyelet 8, as shown. Also a diode 63 is provided having its anode connected to the node 26. The cathode of diode 63 is connected to the collector of transistor 27 and the upper end of PTC resistor 40.

The circuit of FIG. 4A functions in the same manner as FIG. 2A except for the dimming circuit. The dimming circuit of FIG. 4A functions as follows. With the switch 13 in its second position (low light level), half-wave power is supplied through the filament 12 via the SCR 60 which is gated to the "on" condition during alternate half cycles by current flow through the capacitor 62. The diode 63 prevents the filter capacitor 16 from charging to a high enough voltage to operate the trigger oscillator 37 during this low light level.

In the third switch position (high) the ring 7 is not connected to power input, and thus the SCR is "out" of the circuit and the arc lamp operates as described above. In the fourth switch 13 position (high) ring 7 and button contact 8 are connected together and connect the resistor 61 and capacitor 62 in parallel and bias the SCR to the "off" condition.

The operating network depicted in FIGS. 2A and 4A and not including the measures associated with dimmed operation is the subject of U.S. Pat. No. 4,350,930. The following description is information excerpted from that patent application, introduced for purposes of clarifying the application and advantages of the present invention.

In pre-ignition, ignition and glow to arc transition (in the high setting), the transformer 23, the transistor switch 27 and the trigger oscillator (37,etc.) of the operating network assume an active role in generating a high frequency output. The change in electrical output to dc occurring between the glow to arc transition and warmup is in response to conditions in the main lamp. More gradual changes in electrical output of the operating network occur between pre-ignition and ignition and between ignition and the glow to arc transition, and these changes are also in response to conditions in the main lamp.

In pre-ignition, ignition and the glow to arc transition, the operating network produces short duration, high voltage pulses for ignition of the arc lamp, the voltage falling to a lower value in response to lamp loading in the glow to arc transition. During pre-ignition, the unidirectional high voltage pulses have substantial ringing, and they occur at a rate of 50 KHz. In the glow to arc transition, the ringing is reduced and the frequency shifts to 35 KHz. The downward shift in frequency produces a shorter transistor conduction duty cycle, which increases the energy supplied to the lamp in the glow to arc transition. The operating network also supplies current to the filamentary resistance 12 in the form of a series of unidirectional pulses at the 50–35 KHz rate.

The operating network produces the high frequency electrical energization described above as a result of high frequency switching of the monostable transistor switch. Intermittent switching of the transistor switch produces an alternating component in the main primary winding 31 of the step-up transformer, a stepped up alternating component in the transformer output and a pulsating current in the filamentary resistance 12 which is primarily unidirectional.

Alternating current flow in the main primary winding takes place in the following manner. Assuming that the transistor 27 has been turned on by a suitable trigger signal coupled to its input junction, a displacement current path is completed between the positive and common terminals of the dc supply.

The switching transistor presents a low impedance when conducting, and the capacitor 35, the primary feedback winding 33 and the resistance 24 are also low impedances. As the current in the circuit increases, the primary feedback winding, which is inductively coupled to the secondary feedback winding 34, produces regenerative feedback in the input circuit of the transistor and turns it on more strongly. The current build-up continues, however, until a prescribed flux level is reached in the core of the power transformer. At that point, the feedback is inverted to become degenerative, turning off the transistor 27 before full core saturation is reached. The discontinuance of conduction through transistor 27 opens the prior path for current flow through the primary winding and allows a portion of the energy stored in the circuit to dissipate in the form of a reverse current through the filamentary resistance 12.

Figure 3:
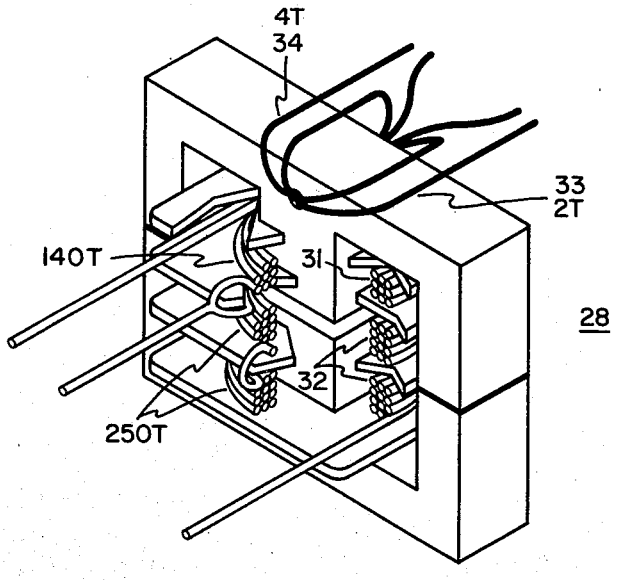
FIG. 3 is a ferrite transformer forming an essential element of the power supply unit.

The transformer 28 which exhibits the feedback reversal characteristic turning off the transistor before full core saturation is reached is the subject of U.S. Pat. No. 4,307,334. That transformer is illustrated in FIG. 3 with the drawing illustrating the double E core or 8 core structure with a control aperture at the base of the center leg formed by the bars of the "E". The main power windings 31 and 32 are shown wound around the center branch corresponding to the bars of the E's while the primary and secondary control windings 33 and 34 are wound through the aperture. The sense of the feedback is dependent upon the flux level in the core surrounding the aperture. The feedback coupling to the secondary control winding 34 is regenerative at low flux levels and degenerative at high flux levels.

The transformed version of the high frequency alternating voltage appearing across the transformer primary winding during pre-ignition, ignition, and the glow to arc transition appears at the terminal of the winding 32 remote from winding 31. The output is coupled from the winding 32 by means of the capacitor 36 to the anode of the arc lamp 11. The output takes the form of unidirectional pulses by virtue of the presence of the diode 23 whose anode is coupled to node 26 and the undotted terminal of the second winding and whose cathode is coupled to the anode of the arc lamp. The diode 23 is poled to permit application of a stepped-up secondary voltage to the arc lamp developed during the reverse current flow in the transformer primary circuit and to suppress application of the secondary voltage developed during forward current flow when the switching transistor is conducting. The transformer 20 is a step-up transformer with a transformer ratio of 640/140 and with the indicated polarity of diode 23 delivers energy to the arc lamp during off periods of the transistor switch. With the indicated parameters, and assuming substantial ringing, the available pre-ignition potential is 1600 volts peak to peak. Preignition is nominally of zero duration when the lamp is cold and from 45 seconds to 4 minutes when the lamp is hot.

The current for standby illumination during preignition, ignition, and the glow to arc transition is produced by high frequency switching of the transistor switch. At the instant that the transistor switch becomes conductive, a direct current path is completed between the positive and common terminals of the dc supply. The dc path includes the standby light producing filamentary resistance 12, the transistor 27 (collector and emitter electrodes, respectively), the primary feedback winding 23 and the current sensing resistance 24. The transistor 27 presents a low impedance when conducting, and the primary feedback winding 23 and the resistance 33 are also low impedances.

In addition to the intermittent current supplied to the filamentary resistance in the dc path just described, the return portion of the alternating current flowing in the primary winding 31 of the transformer also flows through the filamentary resistance as discussed earlier. During pre-ignition, with the secondary winding of the transformer 28 being substantially open-circuited, the heating effect of the reverse current in the primary circuit is negligible. During the glow to arc transition, when the lamp draws the more substantial energy, the alternating current adds significantly to the total dissipation in the filament, in which pulsating deenergization is reduced.

In the high setting, the operating network is responsive to the electrical state of the arc lamp to produce the outputs previously characterized during pre-ignition, ignition and the GAT period. The means by which this responsiveness is accomplished includes the triggering oscillator (transistor 37, etc.) lamp current sensing resistor 24 and the voltage sensing resistors 41, 42 and 43.

The trigger oscillator causes active operation of the transistor switch 19 during pre-ignition, ignition and the GAT period and controls the transistor duty cycle to supply additional energy to the arc lamp during the GAT period. Since the transistor switch is monostable, each trigger pulse supplied from the trigger oscillator initiates a conduction sequence. Should one not want the arc lamp to operate at all, as when the lighting unit is in a low setting and only filamentary illumination is desired, then in accordance with the invention, high frequency operation is prevented by preventing oscillations of the trigger oscillator. The dimming feature, as earlier stated, preserves the flexibility of the power supply to react to rapid changes in lamp voltage and current or line transients.

In the high setting, the trigger oscillator is activated at the time the operating network is first energized, and remains energized through the pre-ignition, ignition and glow to arc transition. During pre-ignition, there is no lamp current, while during ignition and the glow to arc transition, the lamp current increases to one-fifth of an ampere peak in short pulses. The voltage developed in the transformer primary winding at node 26 is high (>300 V) during pre-ignition, falls appreciably under the loading affect of the lamp during ignition, and the glow to arc transition, and consists of a series of pulses initially with substantial ringing.

The foregoing current and voltage conditions reflecting the lamp condition during pre-ignition, ignition and glow to arc transition are sensed in the operating network and combined differentially at the input junction of the oscillator transistor, and used to activate the trigger oscillator. Any lamp current flowing in the lamp current sensing resistance, to which the emitter electrode of the junction transistor 37 is coupled via the low impedance feedback winding 33, produces a voltage in a sense tending to back-bias the input junction. (The lamp current is zero at the start and remains small during these lamp conditions.) The voltage at the node 26 is applied across the voltage divider (41, 42, 43), the lower tap of which is coupled to the base electrode of the transistor 37. The voltage appearing at the node 26 is positive and a fraction (1/181) of that voltage is applied to the base electrode. Here, the voltage is in a sense tending to forward bias the input junction. During pre-ignition, the voltage at node 26 is a maximum and sufficient, assuming time has been allowed for the capacitor 38 to charge up, to forward bias the transistor 37 and initiate oscillation.

The trigger oscillator operates as a relaxation oscillator, capacitor 38 being recurrently charged through the passive elements of the operating network and recurrently discharged by the transistors 27, 37. The charging period of capacitor 38 is determined primarily by the value of capacitor 38, the value of resistor 43, and the differential voltage applied to charge the capacitor 38. The turn-off action of the transformer 28 leave a residual inverse voltage on the capacitor at the end of switch conduction limited by the serially connected diode 29 and resistance 30.

As an examination of the circuit will show, when sufficiently high potentials are present at the node 26 and assuming a low lamp current, the oscillator will start to conduct when the capacitor 38 reaches the value required to forward bias the input junction of the transistor 37 (+0.6 volts) as indicated above. The voltage on the capacitor is determined by the difference between the voltage at the lower voltage divider tap and the voltage due to lamp current in resistor 24.

Once the transistor 37 conducts, current flows in the primary feedback winding 33 and the strongly regenerative feedback action involving secondary feedback winding 34 and capacitor 38 produces a short during trigger pulse for turning on transistor switch 27.

Assuming that the arc lamp current has begun to flow and the voltage across the lamp has begun to increase, the differential voltage used to charge capacitor 38 falls on the average, increasing the period required to turn on the transistor 37 and initiate the next trigger pulse. This provides more time for the energy stored in the input circuit of the operating network to be released to the lamp. Earlier in the starting cycle, the lamp cathode current may be truncated by the next conduction interval, and less stored energy is delivered to the arc lamp. The circuit has been designed so that the nonconduction period is maximum when the lamp voltage is in the glow region (approximately 200–400 volts), to maximize the output power at about 9 watts for metal vapor lamps.

In the high setting, once the arc lamp has reached thermionic operation corresponding to warm-up, the high frequency output produced by transistor switching is designed to stop and the dc state commences. The trigger oscillator, which triggers the monostable transistor switch into active operation, remains reversely biased due to a new set of current and voltage condition in the operating network and becomes inactive. The rectified high frequency voltage at node 26, previously applied across the voltage divider 41, 42, 43 is replaced by a sustained dc voltage with some ripple, representing the lamp voltage. The dc voltage continues in a sense favoring conduction, but is lower by 1 or 2 orders of magnitude. The diode 23, now forward biased, connects the voltage divider across the lamp, and the voltage divider now senses 1/181th of the new lamp voltage, initially 15 volts. Simultaneously, a maximum initial lamp current of 6/10ths of an ampere occurs in resistor 24, developing a conduction inhibiting voltage of approximately 1.2 volts. The differential voltage produces a reverse bias on the input junction of the transistor switch.

As warm-up continues into final run condition, the lamp voltage rises and the lamp current falls. The lamp condition sensors are set to keep the trigger oscillator inactive through warm-up and final run. In final run, the lamp reaches a current of 0.3 amperes and a voltage of 87 volts. Should the lamp voltage rise 10 volts above the normal values (e.g., 97 volts) and the current fall to 0.050 ampere, then the trigger oscillator will be reactivated as a safeguard against transistor dropout.

What is claimed is:

1. A lighting unit having low and high illumination levels for connection to a two thermal ac supply by means of a three terminal power switching supply socket, the first ac supply terminal not being switched, comprising:

A. a plug having first, second and third terminals, the second plug terminal being for connection to said first ac supply terminal, the switching of the first and/or third plug terminal(s) into connection with the second ac supply terminal selecting the illumination level, B. a rectifier bridge having first and second ac input terminals and first, negative, and second, positive, dc output terminals, the bridge first input terminal being connected to said first plug terminal, and the bridge second input terminal being connected to said second plug terminal, C. a first filter capacitor connected between said bridge output terminals, D. a main arc lamp for providing high level illumination, E. an operating network for said arc lamp (1) comprising the following elements:

an incandescible resistive filament for providing low level illumination, an electrical transformer having a first and a second winding mutually coupled to said first winding for deriving a stepped-up output voltage, a solid state switch, a first diode, and control means for effecting intermittent operation or nonconduction of said solid state switch, responsive to said selected illumination level and lamp conditions, (2) said elements being interconnected as follows:

said filament is connected in a first branch between said second bridge output terminal and a node, said first diode and said second winding are connected in parallel, the parallel combination being connected in series with said arc lamp in a second branch between said node and said first bridge output terminal, said switch is connected in a third branch between said node and said first bridge output terminal, said first winding is connected in a fourth branch between said second bridge output terminal and said node to (3) function as follows:

when said solid state switch is intermittently operated, said first third and fourth branches conduct current for energizing said filament and producing an alternating potential in said first winding, inducing a stepped-up ignition potential in said second winding, which is coupled to said lamp, and rectified by said diode, when said solid state switch is nonconductive, said first and second branches ballast and conduct current from said rectifier bridge and filter capacitor for energizing said lamp for normal running operation; and said control means in said high illumination level, maintaining said solid state switch in intermittent operation until said lamp has started and in said non-conducting state thereafter; and in said low illumination, maintaining said solid state switch in a nonconductive state; and F. a rectifier device having its anode coupled to said node and its cathode coupled to said third plug terminal for half-wave conduction through said filament and a portion of said rectifier bridge to said second bridge input terminal for providing filamentary illumination in said low illumination level.

2. A lighting unit as set forth in claim 1 wherein said control means comprises:

A. a trigger oscillator for causing intermittent switch operation for starting said main lamp in said high illumination level, comprising a transistor having base, emitter and collector electrodes, connected in an oscillatory configuration, B. a resistive voltage divider serially connected between said node and said bridge first dc output terminal, C. a first resistance connected in said second branch between said main lamp and said bridge first dc output terminal for producing a voltage drop proportional to the current in said main lamp, and D. means connecting the base of said transistor to a tap on said voltage divider for sensing the voltage across the arc lamp and means connecting the emitter of said transistor to the interconnection between said lamp and said first resistance for sensing current in said main lamp.

3. A lighting unit as set forth in claim 2 wherein said control means comprises means for maintaining said trigger oscillator in a non-oscillatory condition in said low illumination level, including:

A. a second diode having its cathode coupled to said third plug terminal,

B. a second capacitor connected between the anode of said second diode and said bridge first dc output terminal, and C. means coupling the anode of said second diode to said divider to reduce the potential of said base electrode in reference to that of said bridge first output terminal to prevent conduction by said transistor during the half waves that said rectifier device is conducting, said second capacitor sustaining said reduced base potential to prevent conduction by said first transistor during the half waves that said rectifier device is nonconducting.

4. A lighting unit as set forth in claim 3 wherein said means coupling said second diode to said divider comprises:

a third diode having its cathode coupled to the anode of said second diode and its anode connected to said voltage divider, and wherein a second resistance is provided connected between said node and the anode of said second diode, and a third resistance is connected in shunt with said second capacitor, the values of said second and third resistances reversely biasing said third diode and decoupling said second capacitor from said voltage divider in said high illumination level.

5. A lighting unit as set forth in claim 4 wherein a fourth diode is provided having its cathode coupled to said third plug terminal and its anode connected to said bridge first dc output terminal to prevent reversal of the voltage at said node and voltage reversal upon said second capacitor, and a fifth diode is provided having its cathode connected to said bridge second dc output terminal and its anode connected to the cathode of said fourth diode, said fourth and fifth diodes providing protection against line transients in said low illumination level.

6. A lighting unit as set forth in claim 1 wherein said rectifier device is a silicon controlled rectifier device, the anode of said silicon controlled rectifier being connected to said node, the cathode thereof being connected to said third plug terminal, and the gate thereof being capacitively coupled to said first plug terminal.

* * * * *